US006612720B1

(12) United States Patent
Beadle

(10) Patent No.: US 6,612,720 B1
(45) Date of Patent: Sep. 2, 2003

(54) SPOT LIGHT FIXTURE WITH BEAM ADJUSTMENT

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 12 days.

(21) Appl. No.: 09/909,085

(22) Filed: Jul. 19, 2001

(51) Int. Cl.[7] ..... F21V 29/00; F21S 1/00

(52) U.S. Cl. ..... 362/287; 362/431; 362/427; 362/294; 362/373; 362/342

(58) Field of Search ..... 362/431, 267, 362/294, 373, 287, 427, 310, 290, 342, 298, 300, 301, 307

(56) References Cited

U.S. PATENT DOCUMENTS

| | | | | |
|---|---|---|---|---|
| 3,772,527 A | * | 11/1973 | Darling et al. | 362/287 |
| 5,506,761 A | | 4/1996 | Strauss | |
| 5,584,574 A | * | 12/1996 | Haddad | 362/359 |
| 5,649,760 A | | 7/1997 | Beadle | |
| 5,988,833 A | * | 11/1999 | Giese et al. | 362/287 |

* cited by examiner

*Primary Examiner*—Thomas M. Sember
(74) *Attorney, Agent, or Firm*—Kilpatrick Stockton LLP

(57) ABSTRACT

The spot light fixture comprises a housing formed from the combination of a base and a shroud which enclose a reflector assembly. A compression spring in the base generates an outward axial bias to press the reflector assembly toward a window in the end of the shroud. The interior of the shroud, which has a first inner diameter, has an annular ridge which defines a second, smaller inner diameter. One or more optical elements for modification of the beam emitted from the reflector assembly have an outer diameter adapted to fit within the first inner diameter but smaller than the second inner diameter may be inserted into the shroud between the reflector assembly and the annular ridge. One or more rings having an outer diameter which fits within the first inner diameter of the shroud can be inserted between the reflector assembly and annular ridge and any optical elements disposed within the reflector assembly and the annular ridge to cause the reflector assembly to be recessed within the housing for glare reduction. Various combinations of optical elements and rings can be sandwiched between the reflector assembly and the annular ridge to modify the beam as needed to create different lighting effects and/or reduce glare.

28 Claims, 3 Drawing Sheets

SPOT LIGHT FIXTURE WITH BEAM ADJUSTMENT

FIELD OF THE INVENTION

The invention relates to a lighting fixture which provides for adjustment of beam characteristics and glare control and more specifically to a spot light fixture which permits adjustment of beam characteristics and glare which is resistant to corrosion.

BACKGROUND OF THE INVENTION

Environmental lighting, particularly outdoor lighting, is well known in commercial or public settings, such as parks and schools. Such lighting is becoming increasingly popular for residential use, both to enhance the appearance and safety of the outdoor area and for security, to illuminate dark areas around a building or in a yard which may provide hiding places and unobserved entry points for intruders.

Landscape and outdoor lighting systems include one or more lighting fixtures which are connected to either a 12 V transformer or a standard 120 VAC line. The lighting fixtures generally include a housing, a reflector assembly having a halogen or conventional bulb, and a lens or window. Many configurations are known, each of which provides a different lighting effect.

One of the more popular and versatile lighting fixtures is the spot light, which can be used for washing a wall or other surface with light, for creating shadows and silhouettes, for backlighting, and for highlighting features such as trees or statues. A spot light is typically configured as a cylindrical housing attached to a pivoting knuckle joint which allows the light to be directed at variable angles. The knuckle joint may be attached to a mounting brackets for attachment to structures, posts or trees, or placement of the fixtures can be as simple as sticking a tapered spike, which is attached to the pivoting joint, into the ground, so that no structures need to be modified to retain the fixture. Further, the use of a spike allows the fixtures to be placed within planters and lawn areas, and next to trees, away from structures.

A reflector assembly, which is generally parabolic, is typically fixed within the end of the cylindrical housing nearest the open end, so that the light is emitted at a fixed angle from the fixture. The end of the cylinder is enclosed with a clear window to prevent water from pooling and/or to prevent "cooking" of plant matter or dirt directly on any lenses. The clear window, which may be curved (convex) to minimize build-up at its center, is sealed to the housing using a silicone or similar sealant to provide a watertight seal.

In locations where the light fixture is aimed away from a viewer's eyes, for example, where a wall is to be washed with light, glare is not a significant consideration. However, in many applications, such as feature highlighting and downlighting near walkways or other areas where people will be in close proximity to the illuminated feature, glare is a problem that is often considered to be the single most important factor in determining safety and aesthetics of any lighting project. Conventional techniques used to reduce or control glare include external shrouds and baffles. The use of external glare control devices provides a collection point for combustible organic debris such as leaves and twigs at what is commonly the hottest point of the fixture. In some situations, glare can remain a problem even with the use of a baffle or shroud since the fixed placement of the parabolic reflector means that the lamp will still be relatively close to the end of the fixture, allowing the filament to be visible, and glaringly bright, when viewed from certain angles.

It would be desirable to provide a light fixture that can be readily modified to allow beam qualities, such as shape, quality and color of the light, and the amount of glare to be varied without introducing components which result in premature failure of the fixtures or detract from the aesthetic qualities of the fixtures, both of which are important features in environmental lighting systems. These problems and deficiencies are clearly felt in the art and are solved by the present invention in the manner described below.

SUMMARY OF THE INVENTION

It is an advantage of the present invention to provide a spot light fixture which permits insertion of a variety of combinations of filters, lenses and other beam modifiers for modifying shape, quality and color of the light output.

It is a further advantage of the present invention to provide a spot light fixture that can be readily modified to reduce glare to meet the needs of different installation locations within an area to be illuminated.

Another advantage of the present invention is to provide a spot light fixture that can be readily modified after installation while still retaining a watertight seal.

Still another advantage of the present invention is to provide internal glare protection, thus reducing or eliminating the need for deep external shrouds which can collect combustible organic debris.

In an exemplary embodiment, the spot light fixture comprises a housing formed from the combination of a base and a shroud. A reflector assembly, which includes a lamp, is plugged into a socket retained within the base. A compression spring in the base generates an outward axial bias on the reflector assembly to press the reflector assembly toward a window in the distal end of the shroud. The interior of the shroud, which has a first inner diameter, has an annular ridge or a second, smaller inner diameter, the inner edge of which acts as a stop to prevent the reflector assembly from being pushed out of the distal end of the shroud. The outer edge of the ridge provides support for the window, which is attached to the shroud to create a watertight seal. One or more lenses, filters or other optical elements for modification of the beam emitted from the reflector assembly have an outer diameter adapted to fit within the first inner diameter but smaller than the second inner diameter may be inserted into the shroud between the reflector assembly and the annular ridge. One or more rings having an outer diameter which fits within the first inner diameter of the shroud can be inserted between the reflector assembly and annular ridge and any optical elements disposed within the reflector assembly and the annular ridge to cause the reflector assembly to be recessed within the housing for glare reduction. Multiple rings can be used, essentially stacked on one another, to provide a deeper recession of the reflector assembly. In one embodiment the ring is formed with a telescoping feature, allowing its depth to be adjusted, to adjust the depth at which the reflector assembly is recessed into the fixture. A set screw or other fastener can be used to hold the ring at the desired depth once it has been determined. Various combinations of optical elements and rings can be sandwiched between the reflector assembly and the annular ridge to modify the beam as needed to create different lighting effects and/or reduce glare.

The base of the housing has an insert portion with a reduced outer diameter at its distal end to fit within the inner diameter of the shroud at its proximal end. In the preferred embodiment, the base and shroud are press fit together. In an alternate embodiment, the base and shroud are formed with mating threads and are assembled by screwing the shroud onto the base. The insert portion of the base has at least one first annular groove formed in its outer diameter to provide a seat for retaining a first O-ring having a large gauge and a smaller, second annular groove to as act a seat for a second O-ring with a smaller gauge. The second annular groove is positioned to coincide with the inside of the bottom edge of the shroud. The combination of O-rings provides a water-tight seal when the insert portion of the base is fully inserted into the shroud.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
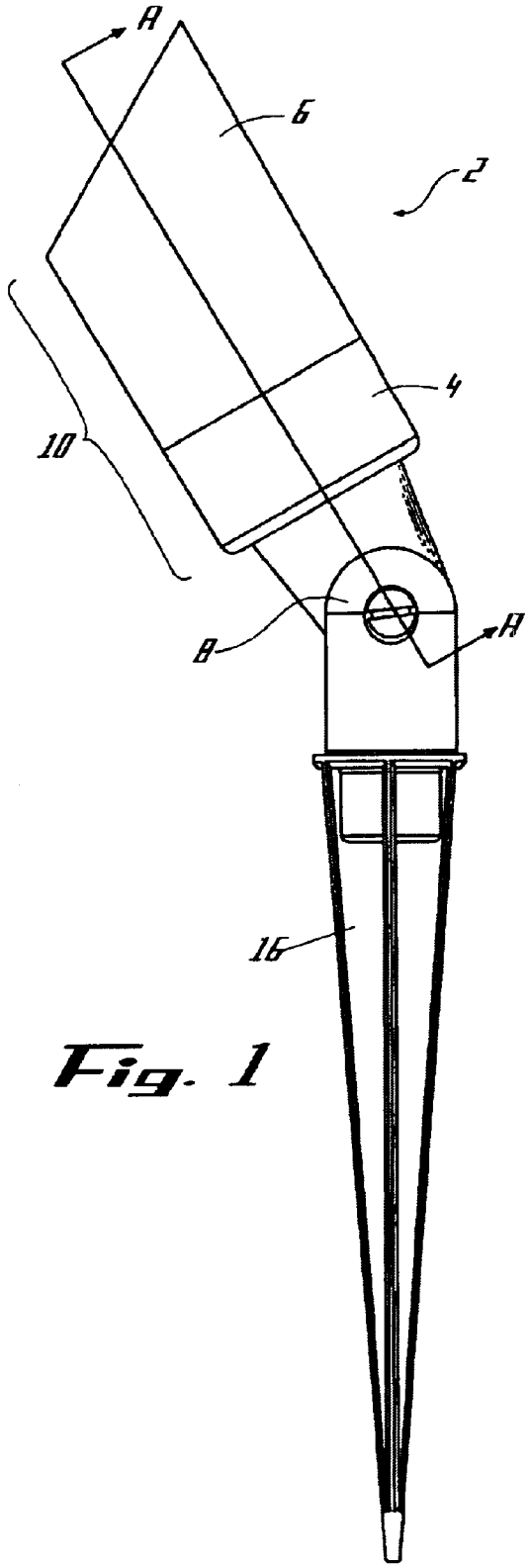
FIG. 1 is a side view of the spot light fixture attached to a spike mount.
Figure 2:
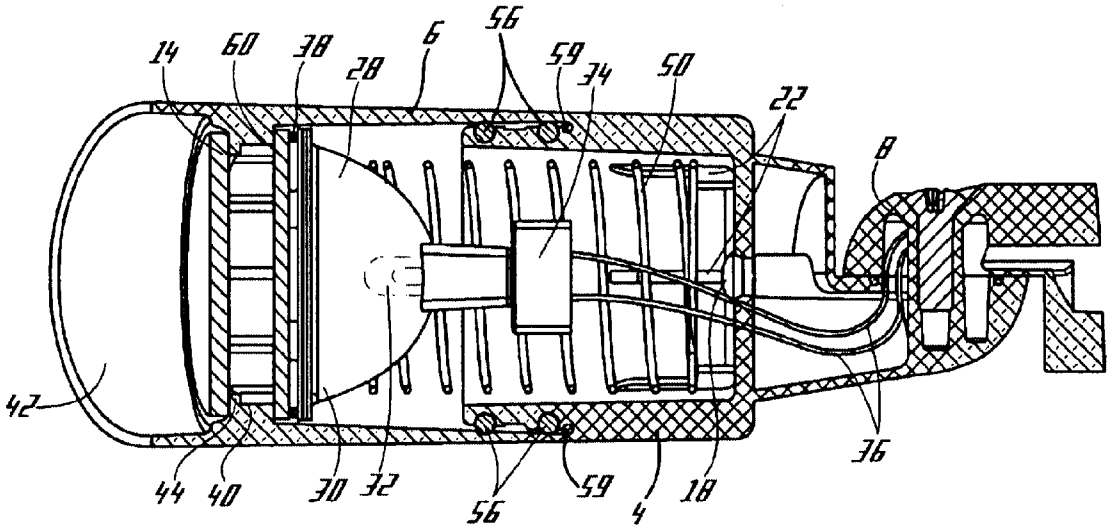
FIG. 2 is a cross-sectional view taken along line A—A of FIG. 1 showing the spot light fixture with a single optical element.

As illustrated in FIGS. 1 and 2, the lighting fixture 2 includes a cylindrical housing 10 formed from the combination of a base 4 and a shroud 6. Housing 10 is preferably made of a durable, corrosion-resistant, and aesthetically pleasing material. Appropriate materials include, but are not limited to, copper, brass, stainless steel, aluminum, zinc, and various alloys thereof, including Zamak #3 (ASTM AG40A, SAE 903) (zinc-aluminum-copper-magnesium alloy), and high temperature plastics or composites. Housing 10 may be formed by machining, die casting, molding, or any other procedure appropriate for the selected materials. After formation, the metals or alloys may be plated, anodized, powder-coated, painted or otherwise treated for enhanced corrosion resistance. In the preferred embodiment, the Housing 10 need not be formed as a straight cylinder but can include formation of an angle between the base and shroud, as long as the shroud is sufficiently long to permit a range of movement of the optical components contained therein. Further, housing 10 is not limited to shapes having a circular cross-section, but can be any polygon as might be desired for decorative purposes, including, but not limited to a triangle, square, hexagon, octagon, etc. Where cross-sectional shapes other than circular are selected, the optical elements used in the fixture will preferably be shaped to match the housing.

Referring to FIG. 2, reflector assembly 28 is disposed within base 4. Reflector assembly 28 comprises a parabolic glass reflector 30 having a faceted interior surface, a halogen bulb 32, or other appropriate light source, mounted in the center of reflector 30, and socket 34. A compression spring 50 is retained concentrically inside of base 4 to create an outward bias against the reflector assembly 28. Spring 50 presses against the bottom end of base 4 and against the underside of reflector assembly 28 to provide a biasing force between the base and reflector assembly 28. As illustrated, a plurality of internal ribs or fins 22 are formed near the bottom of base 4. extending upward, to provide centering and stabilization of spring 50. The lower portion of each fin 22 has an extension upon which the bottom end of the spring sits, while the upper portion of each fin 22 can closely fit the outer diameter of spring 50 to hold the spring it in place. Spring 50 is preferably formed of stainless steel with a length and stiffness which allows a range of axial movement by reflector assembly of at least 50 mm without fully compressing the spring so that the biasing effect is still provided and without compromising the tight fit between the shroud and base. As with other dimensions, the value for the range of axial movement is for an exemplary embodiment. Actual range will be determined by the overall dimensions of the fixture. While a single spring 50 is illustrated, multiple springs evenly placed can be substituted as long as the springs are reasonably well matched for stiffness so that the bias is generally uniform. Alternatively, elastomers, or a combination of elastomers and springs can be used.

A suitable reflector assembly 28 is commercially available from a number of well-known lighting manufacturers, such as Philips, General Electric and Sylvania, and may conform to ANSI standard MR-16. Socket 34 is preferably formed from a ceramic material. Wires 36 extend from socket 34 and exit the lighting fixture through an opening in the threaded end of spike 16 for connection to the voltage supply (not shown), which may be either a 12 V transformer or 120 VAC.

Shroud 6 has a first inner diameter selected to allow reflector assembly 28 to be moved axially within the shroud. In the exemplary embodiment, the first inner diameter is on the order of 50 mm (~2 inches), however, the overall size of the fixture, and the size of the reflector assembly, will determine the inner dimensions. The interior walls of shroud 6 are preferably flared slightly toward the proximal (base) end to facilitate assembly with base 4, and to provide a tighter fit between the shroud and base. Annular ridge or rib 40 is formed in the interior wall of shroud 6 to create a second, smaller inner diameter, which is smaller than the outer diameter of reflector assembly 28. The inner edge of ridge 40 acts as a stop to prevent reflector assembly 28 from being pushed out of the distal end 42 of shroud 6. The outer edge 44 of ridge 40 provides support for window 14.

Transparent window 14 may be domed (convex) to allow water to run off, however, where the fixture is installed at an angle, the tilt of the fixture itself should be sufficient to prevent pooling of water an the window, so that a flat window can be used. Window 14 may be formed from tempered glass, quartz or a hard, clear high temperature plastic or polymer, such as Lexan®. A RTV-silicone, latex, epoxy or similar adhesive is preferably used to attach window 14 within shroud 6 to form a watertight seal against moisture intrusion.

In the preferred embodiment, a retainer spring 38 is provided for placement between the inner edge of ridge 40 and the outer edge of reflector assembly 28. When optical elements 60 and rings 70 are inserted within shroud 6, spring 38 abuts the lowermost insert to hold the inserts in place, keeping them from falling out when shroud 6 is turned with its open end down for re-assembly with base 4. Alternatively, the user's finger can be used to hold the inserts within the shroud during re-assembly, however, this may increase the risk of damage to the inserts or reflector assembly 28. Spring 38 is preferably formed from stainless steel wire into a circular shape with an outer diameter to fit closely within the inner diameter of shroud 6. Outward spring force and friction keep spring 38 in place, i.e., by resilient interference fit, within the inner diameter of shroud 6. A gap between the wire ends allows the spring to be compressed, reducing the spring's effective circumference to permit adjustment of its position within shroud 6. The ends of the wire may be bent perpendicular to the plane of the circle to provide tabs for manipulation of the spring. Typically, adjustment of the axial position of spring 38 is accomplished by using needle-nose pliers or a similar tool to compress the tabs on the ends of the wire, holding the ends together until spring 38 is in the desired position.

One or more lenses, filters, diffusers, baffles, polarizers, or apertures, collectively referred to herein as "optical elements," are provided for modification of the beam emitted from reflector assembly 28. Each optical element 60 has an outer diameter adapted to fit within the first inner diameter of shroud 6 but larger than the second inner diameter of ridge 40, so that optical elements 60 may be inserted into the shroud and trapped between reflector assembly 28 (or retainer spring 38) and ridge 40. The outward bias provided by spring 50 presses reflector assembly 28 against the optical element which, in turn, is pressed against the inner edge of ridge 40. Where retainer spring 38 is used, it will be moved to allow insertion of optical element 60, then replaced so that it is positioned so that it presses against the entrance side of optical element 60. As illustrated in FIG. 2, a single optical element 60 is used.

Figure 3:
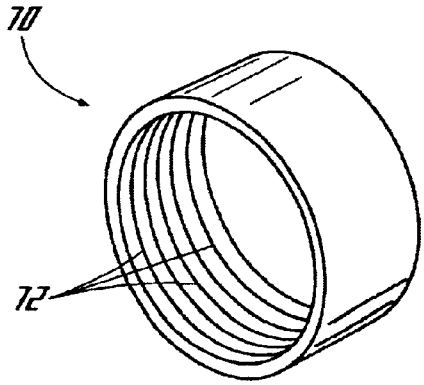
FIG. 3 is a perspective view of a recessor ring for use in the spot light fixture.

Referring to FIG. 3, one or more recessor rings 70 are provided with an outer diameter which fits within the first inner diameter of shroud 6 but is larger than the second inner diameter of ridge 40. The inside wall of ring 70 is treated, either by painting, powder coating or anodizing, to create a flat or matte black finish to absorb/prevent reflection of large angle off-axis light, an important source of glare. In addition or as an alternative to the black finish, a plurality of annular ribs or threads 72 can be formed on the inside wall of ring 70 to act as baffles to further reduce glare. Threads 72 may be square or sawtooth (ACME threads) in cross-section. All surfaces of the threads 72 are preferably finished in black. One or more rings 70 can be inserted between reflector assembly 28 and ridge 40 along with any optical elements 60 disposed within the space between reflector assembly 28 (or retainer spring 38) and ridge 40 to move reflector assembly 28 away from the distal end of shroud 6. The multiple rings 70 can be stacked one on top of the other, or they can be separated by optical elements, thus defining a space between multiple optical elements. By recessing reflector assembly 28 within housing 10, the filament is moved away from the distal end and glare is reduced. Further, because the beam spreads with distance from the source, increasing the distance between the lamp and the point of exit from the fixture causes a wider beam to be emitted from the fixture. In the exemplary embodiment, a ring 70 has a width of about 11.4 mm (0.45 inches), which is selected to approximately correspond to the focus of the reflector 30, so that insertion of one ring 70 between reflector assembly 28 and an optical element 60 will position that optical element at approximately the focus of reflector 30. Different widths may be used in a variety of combinations to provide finer adjustment of the amount of recess.

In an alternate embodiment, ring 70 may be replaced by two or more semi-circular or curved recessor inserts of equal width which conform with the inside wall of shroud 6 to provide the same spacing function as a ring. In such an alternate embodiment, particularly where the recessors are less than half circles, it will be important to ensure that sufficient force is applied to the edges of the separate pieces to hold them in place along the inside wall of shroud 6.

Figure 12:
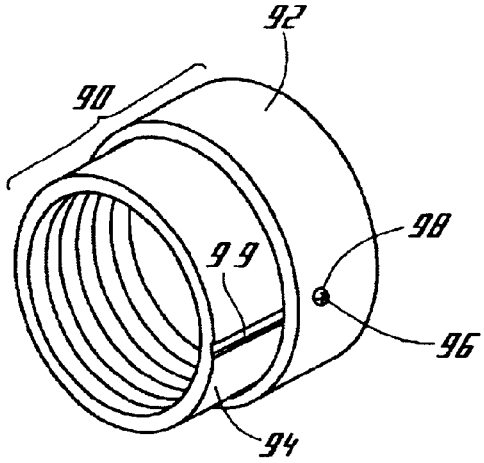
FIG. 12 is a perspective view of an alternative embodiment of the recessor ring with a telescoping feature.

An alternative embodiment of the recessor ring is illustrated in FIG. 12. In this embodiment, rather than stacking multiple rings within shroud 6 to increase the depth of the reflector assembly within the fixture, recessor ring 90 is formed from two concentric rings, 92 and 94, with one ring fitting within the other so that they can be telescoped to extend the total length (depth) of the ring. One or more set screws 96 are inserted through corresponding threaded bores 98 in the larger diameter ring 92. Screw 96 preferably has a uniform diameter along its entire length, i.e., no head, with a slot in its end for receiving a screwdriver tip. Alternatively, bore 98 is countersunk so that the outer end of screw 96 is flush with or recessed within the outer surface of ring 92. While only one screw and bore combination is illustrated, two screw and bore combinations are preferred. When the desired depth of the reflector assembly is determined, set screw 96 is tightened against the outer surface of smaller diameter ring 94, locking the relative position of the two rings to provide a ring that will depress the reflector assembly to the desired depth in the fixture. It may be desirable to form a shallow channel 99 in the outer surface of ring 94 to receive the inner end of screw 96 for more secure engagement.

As illustrated in FIGS. 4–11, and described below as Examples 1–9, various combinations of optical elements 60 and rings 70 can be inserted between reflector assembly 28 and ridge 40 to modify the beam as needed to create different lighting effects and/or reduce glare.

Base 4 of housing 10 has an insert portion 52 with a reduced outer diameter at its distal end to fit within the inner diameter of shroud 6 at its proximal end. In the preferred embodiment, base 4 and shroud 6 are press fit together and held in place by friction using an interference fit. In an alternate embodiment, base 4 and shroud 6 are formed with mating threads and are assembled by screwing the shroud onto the base. Insert portion 52 of base 4 has at least one first annular groove 54 formed in its outer diameter to provide a seat for retaining a first O-ring 56 having a large gauge and a smaller, second annular groove 58 to as act a seat for a second O-ring 59 with a smaller gauge. Second annular groove 58 is positioned to coincide with the inside of the rim 46 of shroud 6, so that a tight fit is provided between the inner walls of shroud 6 and the O-rings. In the preferred embodiments illustrated, two first annular grooves 54 are formed for seating two large gauge O-rings 56. The large gauge O-rings generate frictional resistance when assembling and disassembling housing 10, thus ensuring a tight fit between base 4 and shroud 6. The combination of large and small O-rings provides a watertight seal when the insert portion of the base is fully inserted into the shroud. Separation of shroud 6 and base 4 for removal or insertion of optical elements 60 and rings 70 is achieved by pulling shroud 6 and base 4 apart axially using sufficient force to overcome the frictional resistance created by the larger O-rings.

As shown in FIG. 1, lighting fixture 2 is mounted on a cruciform spike 16, which is connected to the proximal end of housing 10 by pivot joint 8. Details of a preferred embodiment of the hinge are disclosed in copending application Ser. No. 09/536,676, filed Mar. 28, 2000, the disclosure of which is incorporated herein by reference. Pivot joint 8 is preferably formed from a durable, corrosion-resistant metal, such as copper, brass, stainless steel or aluminum, which may be treated to enhance corrosion resistance, or a hard plastic. Machine screws 18, shown in FIG. 2, or other appropriate fastener(s), extend through the wall of housing 10 into the top 10 of pivot joint 8. The fixture may be installed in an outdoor location by forcing spike 16 into the ground (not shown). Alternatively, lighting fixture 2 may be attached to a mounting bracket for attachment to a post, wall, tree, or other structural surface using methods that are known in the art.

The following examples are provided to illustrate use of the inventive spot light fixture in a number of different applications using different combinations of optical elements and/or rings. These examples are not intended to be exhaustive and additional combinations of optical elements and/or rings will be readily apparent to those of skill in the art using the disclosure provided herein.

EXAMPLE 1

Wall Illumination

The embodiment illustrated in FIG. 2 provides an example of a modification of the basic lighting fixture (no filters) with a single optical element 60 which may be used for placement in locations where it is unlikely that anyone in the area being lit will be able to directly view the fixture. In such situations, glare is not a major concern. The single optical element 60 in this case is a frosted diffuser which provides a uniform spread of light which washes a feature, such as a structure wall, with light. The wall reflects a soft, glare-free ambient glow onto the surrounding area which can be used as an alternative to direct path lighting.

EXAMPLE 2

Feature Illumination

Figure 4:
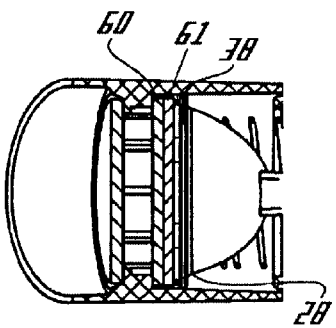
FIG. 4 is a partial cross-sectional view taken along line A—A of FIG. 1 showing the spot light fixture with a first exemplary combination of optical elements.

The embodiment illustrated in FIG. 4 modifies a basic lighting fixture by using a combination of two optical elements 60 and 61 comprising a frosted diffuser (60) and a color filter 61. For illuminating features such as large boulders with a smooth, warm light, color filter 61 is peach or gold colored. For a water feature, blue may be used and for accenting plants, a green filter might be used. As in Example 1, the feature is at some distance from passers-by so glare is not a major concern and additional shifting of the reflector assembly 28 beyond that provided by the thickness of the elements 60 and 61 is not necessary.

EXAMPLE 3

Feature Illumination in "Walk-by" Area

Figure 5:
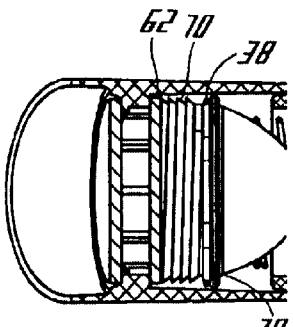
FIG. 5 is a partial cross-sectional view taken along line A—A of FIG. 1 showing the spot light fixture with a second exemplary combination of optical elements.

For illumination of a feature in an area where people may be walking by or able to move in close proximity to the fixture, the embodiment illustrated in FIG. 5 modifies the basic lighting fixture by adding a combination of a single optical element in the form of a honeycomb filter 62 and one ring 70 for recessing the reflector assembly 28 within the housing and preventing reflection of large angle off-axis light. The honeycomb filter 62 is positioned on the distal side of ring 70 to control scatter of the light emitted from the recessed reflector assembly, so that if a passer-by were to look at the fixture from any angle but directly in front, the baffling provided by filter 62 would minimize the visibility of the fixture itself, drawing more attention to the feature intended to be highlighted.

EXAMPLE 4

Spread Lighting in Walk-by Area

Figure 6:
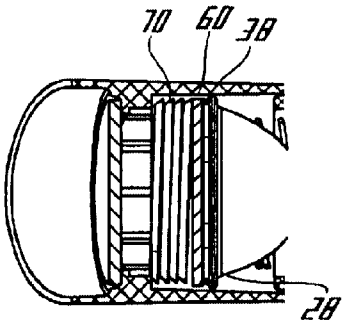
FIG. 6 is a partial cross-sectional view taken along line A—A of FIG. 1 showing the spot light fixture with a third exemplary combination of optical elements and rings.

FIG. 6 illustrates a combination of elements and rings which can be used for washing a large area with light with minimum glare. Ring 70 is used to recess reflector assembly 28 back into the housing. A frosted lens is placed between the proximal end of ring 70 and reflector assembly 28 to homogenize the light prior to cutting down large angle off-axis reflections within ring 70.

EXAMPLE 5

Downlighing from Above Eye Level

Figure 7:
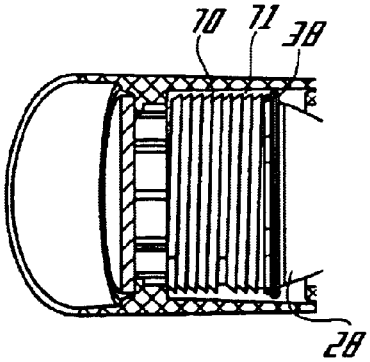
FIG. 7 is a partial cross-sectional view taken along line A—A of FIG. 1 showing the spot light fixture with a fourth exemplary combination of optical elements and rings.

FIG. 7 shows a lighting fixture which can be used for installation high in a tree for creating shadow patterns of leaves with a low level of ambient illumination on the ground below, to mimic moonlight. With conventional fixtures, the glare resulting from this type of installation creates a hot spot focus in the tree that can distract a viewer's attention from the subtle glow on the ground. This problem is alleviated by placing two rings 70, 71 in front of reflector assembly 28 to push the reflector assembly deep within the housing and to provide extra baffles to significantly cut down on large angle off-axis reflections.

EXAMPLE 6

Downlighting from Above Eye Level with Filter

Figure 8:
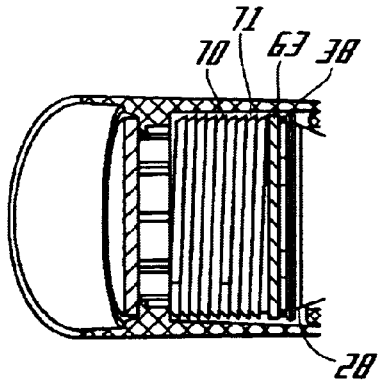
FIG. 8 is a partial cross-sectional view taken along line A—A of FIG. 1 showing the spot light fixture with a fifth exemplary combination of optical elements and rings.

To soften or add color to a downlighting application where glare control is important, the example illustrated in FIG. 8 utilizes two rings 70 and 71, to recess reflector assembly 28 deep within housing 10, as in the preceding example, and adds a filter 63 between the lowermost ring 71. Filter 63 can be a honeycomb filter, for scatter control, to minimize the apparent brightness of the fixture, or a color filter, to vary the "temperature" of the light, making it cooler or warmer by selecting cool or warm tones.

EXAMPLE 7

Accent Downlighting

Figure 9:
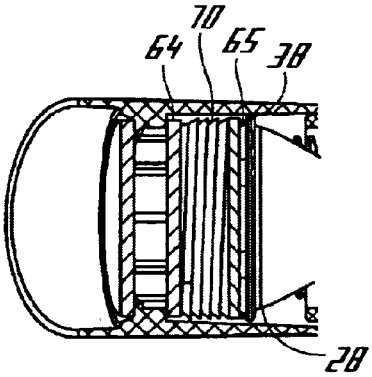
FIG. 9 is a partial cross-sectional view taken along line A—A of FIG. 1 showing the spot light fixture with a sixth exemplary combination of optical elements and rings.
Figure 10:
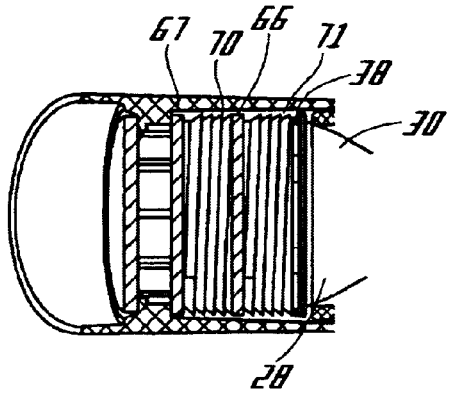
FIG. 10 is a partial cross-sectional view taken along line A—A of FIG. 1 showing the spot light fixture with a seventh exemplary combination of optical elements and rings.
Figure 11:
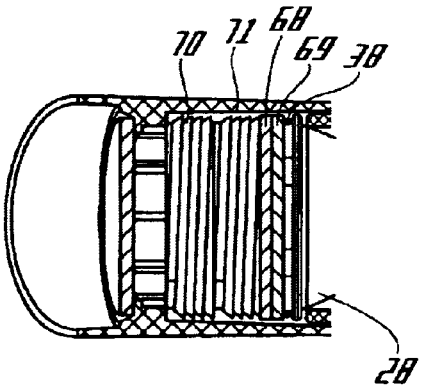
FIG. 11 is a partial cross-sectional view taken along line A—A of FIG. 1 showing the spot light fixture with a eighth exemplary combination of optical elements and rings.

Accenting of garden details such as statues, boulders or topiary can be done using a remote light source with a narrow beam pattern. In this example, color is used to bring out features of the illuminated object. Typically, such a fixture is hidden from direct view by eaves or trellises, so that glare is not as great a factor. Nonetheless, because the fixture may be at or above eye level, glare reduction is desirable. As illustrated in FIG. 9, scatter control is provided by honeycomb filter 64, which is positioned near the window end of shroud 6 to avoid drawing the viewer's eye to the fixture itself. Glare reduction is provided by inserting a ring 70 beneath honeycomb filter 64, and color is added by inserting color filter 65 between ring 70 and reflector assembly 28 (or retainer spring 38.)

EXAMPLE 8

Downlighting with Directed Beam Spread

Accent lighting of features that are elongated along a particular line, e.g., vertically or horizontally, can be achieved by concentrating the beam in one direction corresponding to the elongation. This is particularly desirable to enhance the contrast between the feature to be highlighted from its surroundings. A refractive element such as a linear spread filter causes the light beam to be concentrated along a line. This effect can be created by the combination shown in FIG. 10, using a pair of rings 70, 71 and linear spread filter 66. As shown, filter 66 is positioned between rings 70 and 71. This places filter 66 at the approximate focus of parabolic reflector 30. By shifting filter 66 either toward or away from reflector assembly 28, i.e., moving filter 66 to the other side of either ring 71 or 70, the line can be made less or more distinct, respectively. Color filter 67 is included to enhance colors in the feature being illuminated.

EXAMPLE 9

Downlighting with Directed Two-way Beam Spread

Highlighting by creating an interesting pattern on a feature surface can be achieved using a prismatic filter 68, which is a refractive element with an array of separate focusing elements to create an illumination pattern with many points of light, for a shimmering appearance. Because such a fixture would likely be in an area where people will be present, a high level of glare reduction is desired. In the combination shown in FIG. 11, two rings 70, 71 are placed in shroud 6, followed by prismatic filter 68, and color filter 69 to soften the light. As with Example 8, changing the position of prismatic filter 68 will vary the distinctness of the pattern created. In the positioning shown, the pattern will be less distinct so that a soft lighting pattern is created.

The lighting fixture of the present invention provides a wide range of beam control for shaping, spread and color, and glare reduction, with the entire mechanism sealed against the elements. The variations that are possible using different combinations of optical elements and ring permits the use of a single type of spot light for many different lighting applications. Adjustment of the beam characteristics can be readily performed on site, so that fixtures need not be removed if an incorrect choice was made in the original set-up or if a different lighting effect is desired.

Obviously, other embodiments and modifications of the present invention will occur readily to those of ordinary skill in the art in view of these teachings. Therefore, this invention is to be limited only by the following claims which include all such other embodiments and modifications when viewed in conjunction with the above specification and accompanying drawings.

I claim:

1. A spot light fixture with beam adjustment, comprising:

a housing comprising a base and a shroud, the shroud having a first inner diameter and a ridge formed therein, the ridge forming a second inner diameter that is smaller that the first inner diameter, and the base having an insert portion adapted for mating with the inner diameter at a proximal end of the shroud;

a window disposed within a distal end of the shroud;

a compression spring having a first end and a second end, wherein the first end is disposed within the base;

a reflector assembly disposed at the second end of the compression spring, wherein the compression spring generates a bias to push the reflector assembly away from the base and toward the window; and at least one insert having a first outer diameter adapted to fit within the first inner diameter and larger than the second inner diameter for removable insertion into the shroud, the at least one insert comprising at least one of an optical element and a recessor, the recessor having an inner surface adapted for reducing reflection of light from the inner surface and a width adapted to force the reflector assembly away from the window.

2. The spot light fixture of claim 1, further comprising a retaining spring having an outer diameter adapted to closely fit within the first inner diameter of the shroud, the retaining spring providing a force for holding the at least one insert within the shroud.

3. The spot light fixture of claim 1, wherein the inner surface of the recessor is finished with a matte black or flat black finish.

4. The spot light fixture of claim 1, wherein the recessor comprises telescoping rings and the width of the recessor is adjustable.

5. The spot light fixture of claim 1, wherein the at least one optical element is selected from the group consisting of honeycomb filter, color filter, frosted filter, linear spread filter, and prismatic filter.

6. The spot light fixture of claim 1, wherein the width of the recessor corresponds to a focus of the reflector assembly.

7. The spot light fixture of claim 1, wherein the at least one optical element comprises a combination of a recessor and a honeycomb filter, wherein the recessor is disposed between the honeycomb filter and the reflector assembly.

8. The spot light fixture of claim 1, wherein the inner surface of the recessor has a plurality of annular ribs formed thereon.

9. The spot light fixture of claim 1 further comprising at least one O-ring disposed on the insert portion of the base for providing a watertight seal between the shroud and the base.

10. The spot light fixture of claim 9, wherein the at least one O-ring comprises at least one large gauge O-ring and a small gauge O-ring and further comprising an annular groove formed in the insert portion of the base to act as a seat for each of the at least one large gauge O-ring and the small gauge O-ring.

11. The spot light fixture of claim 9, wherein the recessor comprises telescoping rings and the width of the recessor is adjustable.

12. A spot light fixture with beam adjustment, comprising:

a hollow base having an inner wall and a insert portion, the insert portion having a plurality of annular grooves formed therein;

a hollow shroud having an inside wall with a first inner diameter and a ridge formed therein near a distal end, the ridge defining a second inner diameter that is smaller that the first inner diameter, wherein the first inner diameter is adapted to mate with the insert portion of the base to form a housing;

a window disposed within the distal end of the shroud;

a compression spring disposed within the base, the compression spring having a first end and a second end, the first end being disposed adjacent the inner wall of the base;

a reflector assembly disposed at the second end of the compression spring, wherein the compression spring generates a bias to push the reflector assembly away from the inner wall of the base and toward the window;

at least one optical element having a first outer diameter adapted to fit within the first inner diameter and larger than the second inner diameter for removable insertion into the shroud, wherein the at least one optical element modifies a beam emitted from the reflector assembly;

at least one recessor ring having a second outer diameter adapted to fit within the first inner diameter and larger than the second inner diameter for removable insertion into the shroud, the recessor ring having an inner surface coated with a non-reflective material and a plurality of annular ribs formed thereon for reducing reflection of light from the inner surface, and a width adapted to force the reflector assembly away from the window to reduce glare from light from the reflector assembly;

a retainer spring for retaining the at least one optical element and the at least one recessor ring within the shroud;

at least one first O-ring having a first gauge disposed in one of the annular grooves in the insert portion of the base, wherein the first O-ring generates friction with the inside wall of the shroud; and a second O-ring having a second gauge smaller than the first gauge disposed in another of the annular grooves, wherein the second O-ring is disposed to abut an inside rim of the shroud when the housing is assembled to create a watertight seal between the shroud and the base.

13. The spot light fixture of claim 12, wherein the at least first O-ring comprises two large gauge O-rings.

14. A spot light fixture with beam adjustment, comprising:

a hollow base having an inner wall and a insert portion, the insert portion having at least one annular groove formed therein;

a hollow shroud having an inside wall with a first inner diameter and a ridge formed therein near a distal end, the ridge defining a second inner diameter that is smaller that the first inner diameter, wherein the first inner diameter is adapted to mate with the insert portion of the base to form a housing;

a window disposed within the distal end of the shroud;

a compression spring having a first end and a second end, wherein the first end is disposed within the base;

a reflector assembly disposed at the second end of the compression spring, wherein the compression spring generates a bias to push the reflector assembly away from the base and toward the window;

at least one optical element having a first outer diameter adapted to fit within the first inner diameter and larger than the second inner diameter for removable insertion into the shroud, wherein the at least one optical element modifies a beam emitted from the reflector assembly;

at least one recessor ring having a second outer diameter adapted to fit within the first inner diameter and larger than the second inner diameter for removable insertion into the shroud, the recessor ring having an inner surface adapted for reducing reflection of light from the inner surface, and a width adapted to force the reflector assembly away from the window;

a retainer spring for retaining the at least one optical element and the at least one recessor ring within the shroud; and at least one first O-ring having a first gauge disposed in the at least one annular groove in the insert portion of the base, wherein the at least one first O-ring generates friction with the inside wall of the shroud.

15. A method for adjusting a beam produced by a spot light fixture comprising a housing enclosing a reflector assembly, the method comprising the steps of:

opening the housing by separating a base from a shroud, wherein the base has an insert portion that mates with an inner diameter of the shroud and the shroud has a window disposed within a distal end;

releasing compression of a spring disposed within the base for generating a bias for pushing the reflector assembly toward the shroud;

removing a retaining spring disposed within the interior of the shroud;

inserting within the interior of the shroud at least one insert having a first outer diameter adapted to fit within the inner diameter of the shroud, the at least one insert comprising at least one of an optical element and a recessor, the recessor having a plurality of annular ribs formed on an inner surface for reducing reflection of light from the inner surface and a width adapted to force the reflector assembly away from the window to reduce glare from light from the reflector assembly;

replacing the retaining spring to hold the at least one insert within the shroud;

aligning the shroud with the base so that the reflector assembly is within the shroud; and moving the shroud axially relative to the base so that the retaining spring presses against the reflector assembly and compresses the spring and moves the reflector assembly away from the window.

16. The method of claim 15, wherein the at least one optical element is selected from the group consisting of honeycomb filter, color filter, frosted filter, linear spread filter, and prismatic filter.

17. The spot light fixture of claim 14, wherein the at least one annular groove comprises a plurality of annular grooves and further comprising a second O-ring having a second gauge smaller than the first gauge disposed in another of the annular grooves, wherein the second O-ring is disposed to abut an inside rim of the shroud when the housing is assembled to create a watertight seal between the shroud and the base.

18. The spot light fixture of claim 14, wherein the inner surface of the recessor has a plurality of annular ribs formed thereon.

19. The spot light fixture of claim 18, wherein the inner surface of the recessor is finished with a matte black or flat black finish.

20. The spot light fixture of claim 14, wherein the inner surface of the recessor is finished with a matte black or flat black finish.

21. A method for adjusting a beam produced by a spot light fixture comprising a housing enclosing a reflector assembly, the method comprising the steps of:

opening the housing by separating a base from a shroud, wherein the base has an insert portion that mates with an inner diameter of the shroud and the shroud has a window disposed within a distal end;

releasing compression of a spring disposed within the base for generating a bias for pushing the reflector assembly toward the shroud;

removing a retaining spring disposed within the interior of the shroud;

inserting within the interior of the shroud at least one insert having a first outer diameter adapted to fit within the inner diameter of the shroud, the at least one insert comprising at least one of an optical element and a recessor, the recessor having an inner surface adapted for reducing reflection of light from the inner surface and a width adapted to force the reflector assembly;

replacing the retaining spring to hold the at least one insert within the shroud;

aligning the shroud with the base so that the reflector assembly is within the shroud; and moving the shroud axially relative to the base so that the retaining spring presses against the reflector assembly and compresses the spring and moves the reflector assembly away from the window.

22. The method of claim 21, wherein the at least one optical element is selected from the group consisting of honeycomb filter, color filter, frosted filter, linear spread filter, and prismatic filter.

23. The method of claim 21, wherein the width of the recessor corresponds to a focus of the reflector assembly.

24. The method of claim 21, wherein the recessor comprises telescoping rings and the step of inserting further comprises adjusting the width of the recessor by sliding one telescoping ring relative to another telescoping rings.

25. The method of claim 21, wherein the at least one optical element comprises a combination of recessor and a honeycomb filter, wherein the recessor is disposed between the honeycomb filter and the reflector assembly.

26. The method of claim 21, wherein the insert portion of the base has a plurality of annular grooves formed therein, and at least one first O-ring having a first gauge is disposed in one of the annular grooves for generating friction with the inside wall of the shroud; and a second O-ring having a second gauge smaller than the first gauge is disposed in another of the annular grooves for abutting an inside rim of the shroud when the housing is assembled to create a watertight seal between the shroud and the base.

27. The method of claim 21, wherein the inner surface of the recessor is finished with a matte black or flat black finish.

28. The method of claim 21, wherein the inner surface of the recessor has a plurality of annular ribs formed thereon.

* * * * *